US009994037B2

(12) United States Patent
Sakai

(10) Patent No.: US 9,994,037 B2
(45) Date of Patent: Jun. 12, 2018

(54) LIQUID CONTAINER

(71) Applicant: SEIKO EPSON CORPORATION, Tokyo (JP)

(72) Inventor: Toshifumi Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/088,640

(22) Filed: Apr. 1, 2016

(65) Prior Publication Data

US 2016/0303863 A1 Oct. 20, 2016

(30) Foreign Application Priority Data

Apr. 16, 2015 (JP) ..... 2015-083975

(51) Int. Cl.
*B41J 2/175* (2006.01)

(52) U.S. Cl.
CPC ..... *B41J 2/17596* (2013.01); *B41J 2/17506* (2013.01); *B41J 2/17509* (2013.01); *B41J 2/17513* (2013.01); *B41J 2002/17516* (2013.01)

(58) Field of Classification Search
CPC ..... B65D 47/2031; B65D 47/2018
See application file for complete search history.

(56) References Cited

U.S. PATENT DOCUMENTS 3,308,809 A * 3/1967 Cohen ..... A61B 5/15003 422/515
4,743,233 A * 5/1988 Schneider ..... A61M 5/3243 604/192
5,307,955 A * 5/1994 Viegas ..... B65D 47/2031 222/107
5,816,457 A * 10/1998 Croft ..... A45F 3/04 224/148.2
5,974,971 A 11/1999 Moller et al.
6,050,451 A * 4/2000 Hess, III ..... B65D 47/2031 105/107
2003/0009079 A1* 1/2003 Beaufore ..... A61F 2/0013 600/29
2003/0029890 A1* 2/2003 Olechowski ..... B65D 47/2031 222/525
2004/0139868 A1 7/2004 Arai et al.
2007/0284397 A1* 12/2007 Hickok ..... B65D 47/2031 222/494
2008/0035596 A1* 2/2008 Frisch ..... A61J 11/002 215/6
2011/0079300 A1* 4/2011 Kneer ..... B65D 47/18 137/511

FOREIGN PATENT DOCUMENTS

JP 11-240138 A 9/1999
JP 2002-046338 A 2/2002
JP 2004-237722 A 8/2004
JP 2009-066940 A 4/2009
JP 2012-152995 A 8/2012

* cited by examiner

*Primary Examiner* — Shelby Fidler

(57) ABSTRACT

A liquid container is provided which includes a liquid containing section that contains ink, a spout from which the ink contained in the liquid containing section is poured, and a valve mechanism section that allows the ink to be poured by being deformed by action of an external force between the liquid containing section and the spout.

5 Claims, 8 Drawing Sheets

LIQUID CONTAINER

The entire disclosure of Japanese Patent Application No. 2015-083975, filed Apr. 16, 2015 is incorporated by reference herein.

BACKGROUND

1. Technical Field

The present invention relates to a liquid container.

2. Related Art

An ink jet printer, which is an example of a liquid ejecting apparatus, is provided with an ink tank containing ink, and the ink is supplied from the ink tank to a recording head. The ink supplied to the recording head is ejected to a recording medium such as a printing paper and printing is performed. The ink in the ink tank is consumed while the printing is performed. Therefore, there is an apparatus in which ink contained in a liquid container is replenished into an ink tank (for example, JP-A-2012-152995).

When replenishing the ink tank with the ink contained in the liquid container, a user opens a lid of a spout of the liquid container, inserts the spout into an inlet of the ink tank by tilting the liquid container, and pours the ink into the ink tank. After completing the pouring of the ink, the user restores the posture of the liquid container and closes the spout with the lid.

However, there is a problem that the ink spills during the operation.

The same goes for various liquid containers that contain liquid, which are used for various usages, in addition to the ink container used for the liquid ejecting apparatus.

SUMMARY

The invention is made to solve at least a part of the above problem and can be realized as embodiments or application examples described below.

Application Example 1

A liquid container characterized by including a liquid containing section that contains liquid, a spout from which the liquid contained in the liquid containing section is poured, and a valve mechanism section, which allows the liquid to be poured by being deformed by action of a force from outside, between the liquid containing section and the spout.

According to this application example, the liquid container includes the valve mechanism section, which allows the liquid to be poured by being deformed by action of a force from the outside, between the liquid containing section and the spout. Thereby, when the liquid container is held in a state in which the spout is inserted into the inlet of the ink tank and a force is applied to the valve mechanism section from the outside, the valve mechanism section is deformed and the ink is allowed to be poured. Therefore, when the liquid is not poured into the ink tank, if no external force is applied, the ink is not allowed to be poured, so that it is possible to prevent the ink from spilling out from the spout of the liquid container to an area around the inlet of the ink tank when the liquid container is tilted or the posture of the liquid container is intended to be restored.

Application Example 2

The liquid container characterized in that the valve mechanism section is deformed and allows the liquid to be poured when a force is applied from outside and restores its original shape and prevents the liquid from being poured when no force is applied from outside.

According to this application example, when the liquid container is held in a state in which the spout is inserted into the inlet of the ink tank and a force is applied from the outside to the valve mechanism section, an opening/closing section opens and the liquid is poured, and when no force is applied from the outside, the opening/closing section closes and the pouring of the liquid stops.

Application Example 3

The liquid container characterized by including a valve mechanism containing section, which contains the valve mechanism section, in a region between the valve mechanism section and the liquid containing section. The valve mechanism section can move to a containing position where the valve mechanism section is contained in the valve mechanism containing section and a use position outside the valve mechanism containing section.

According to this application example, when the valve mechanism section is located at the containing position where the valve mechanism section is contained in the valve mechanism containing section, even if an external force is applied to the valve mechanism containing section, no force is applied to the valve mechanism section. Therefore, the valve mechanism section is not deformed, so that the opening/closing section is not opened. Therefore, when the liquid container is not used, if the valve mechanism section is located at the containing position where the valve mechanism section is contained in the valve mechanism containing section, it is possible to prevent the liquid from flowing out from the spout.

Application Example 4

The liquid container characterized by including a support section that attachably and detachably supports a cap that covers the valve mechanism section.

According to this application example, when the cap is attached to the liquid containing section and the valve mechanism section is covered by the cap, even if a force is applied to the cap, no force is applied to the valve mechanism section, so that the liquid is not allowed to be poured from the spout. Thereby, when the cap is attached to the support section, it is possible to prevent the liquid from spilling out from the spout.

Application Example 5

The liquid container characterized in that a member that forms the valve mechanism section is softer than a member that forms the liquid containing section.

According to this application example, when a force is applied to the valve mechanism section from the outside, the valve mechanism section can be deformed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described with reference to the drawings.

First Embodiment

Figure 1A:
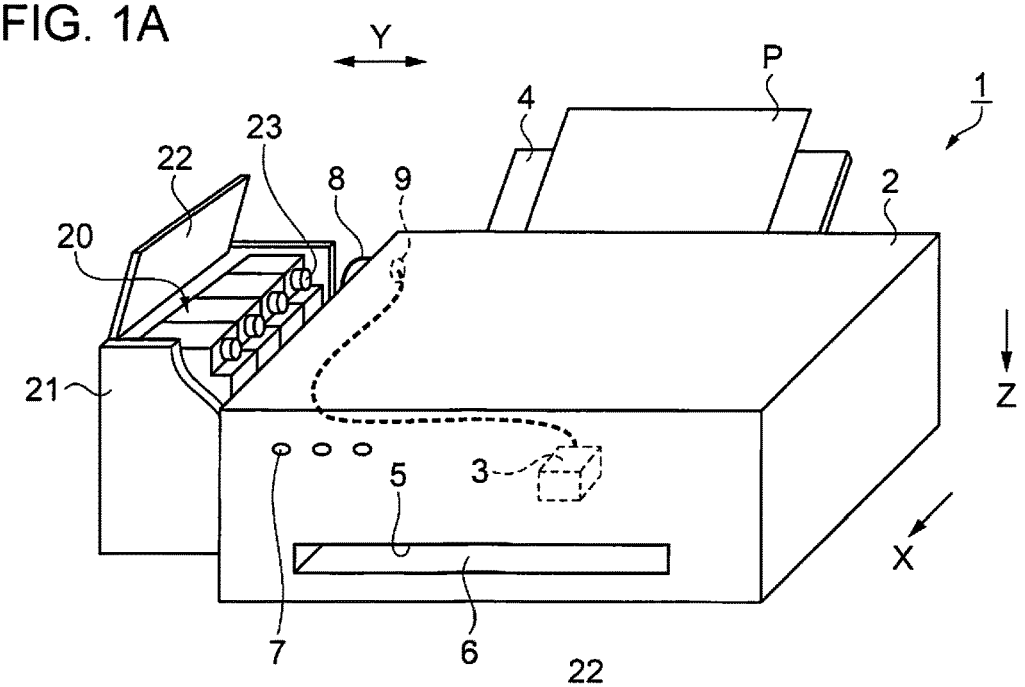
FIG. 1A is an external perspective view of an ink jet printer.

FIG. 1A is an external perspective view of an ink jet printer 1, which is an example of a liquid ejecting apparatus, as seen from the front. An ink head 3 that ejects ink is included inside a housing 2.

A paper support 4 on which a recording medium such as a paper is mounted is provided on the rear side of the housing 2. The paper P mounted on the paper support 4 is fed to the inside of the housing 2 by a paper feed apparatus (not shown in the drawings) included in the housing 2.

The paper P fed to the inside of the housing 2 is transported in a transport direction X. The ink head 3 ejects ink to the paper being transported and records characters and images on the paper.

The housing 2 is provided with an operation buttons 7 by which an operation of power on/off and setting of printing conditions are performed. The paper on which characters and images are formed in the housing 2 is transported along a transport path 6 and discharged from a discharging opening 5 formed in a front surface of the housing 2.

On the left side of the housing 2 in FIG. 1A, a case 21 that houses an ink tank 20 is arranged separately from the housing 2. FIG. 1A shows a state in which an upper cover 22 provided rotatably is opened.

Figure 1B:
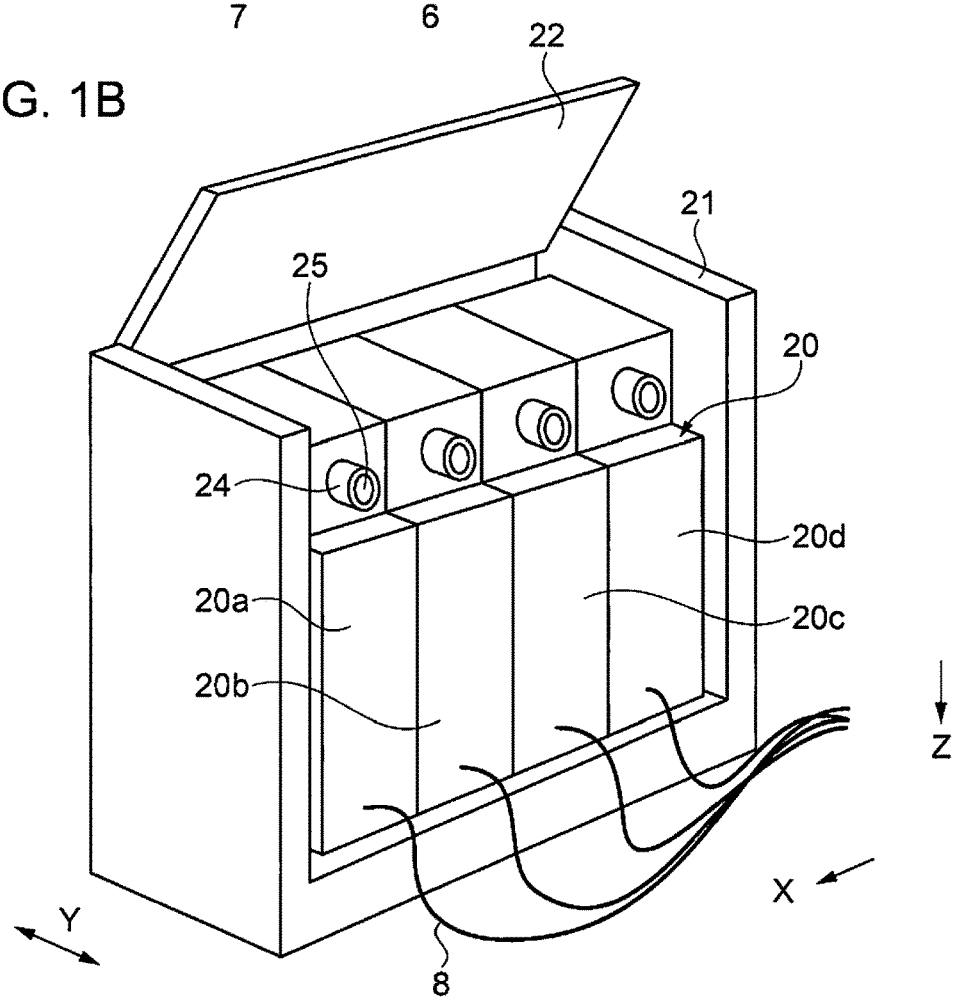
FIG. 1B is a perspective view of an ink tank housed in a case.

FIG. 1B is a perspective view of the ink tank 20 housed in the case 21. The inside of the ink tank 20 that is integrally formed is partitioned into reservoir sections 20*a*, 20*b*, 20*c*, and 20*d*. The reservoir sections 20*a* to 20*d* reserve inks of yellow, magenta, cyan, and monochrome, respectively. However, if inks of the other colors are used, it is possible to provide reservoir sections to reserve the inks. The number of inks can be any number greater than or equal to 1 and it is desirable to provide the reservoir sections, the number of which is equal to the number of inks.

FIG. 1B shows a state in which caps 23 in FIG. 1A are removed. As shown in FIG. 1B, on an upper outer wall surface of each of the reservoir sections 20*a* to 20*d*, an inlet forming section 24 protruding from the outer wall surface is provided. An inlet 25 for replenishing ink in the ink tank 20 is formed in the inlet forming section 24.

A liquid tube 8 in FIG. 1B is provided for each of four inks. One ends of the liquid tubes 8 are respectively connected to lower portions of the reservoir sections 20*a* to 20*d* and the other ends of the liquid tubes 8 in FIG. 1A pass through a through hole 9 provided in the left side surface of the housing 2 in FIG. 1A and communicate with the ink head 3. The shape of the liquid tube 8 can be flexibly changed.

Figure 2:
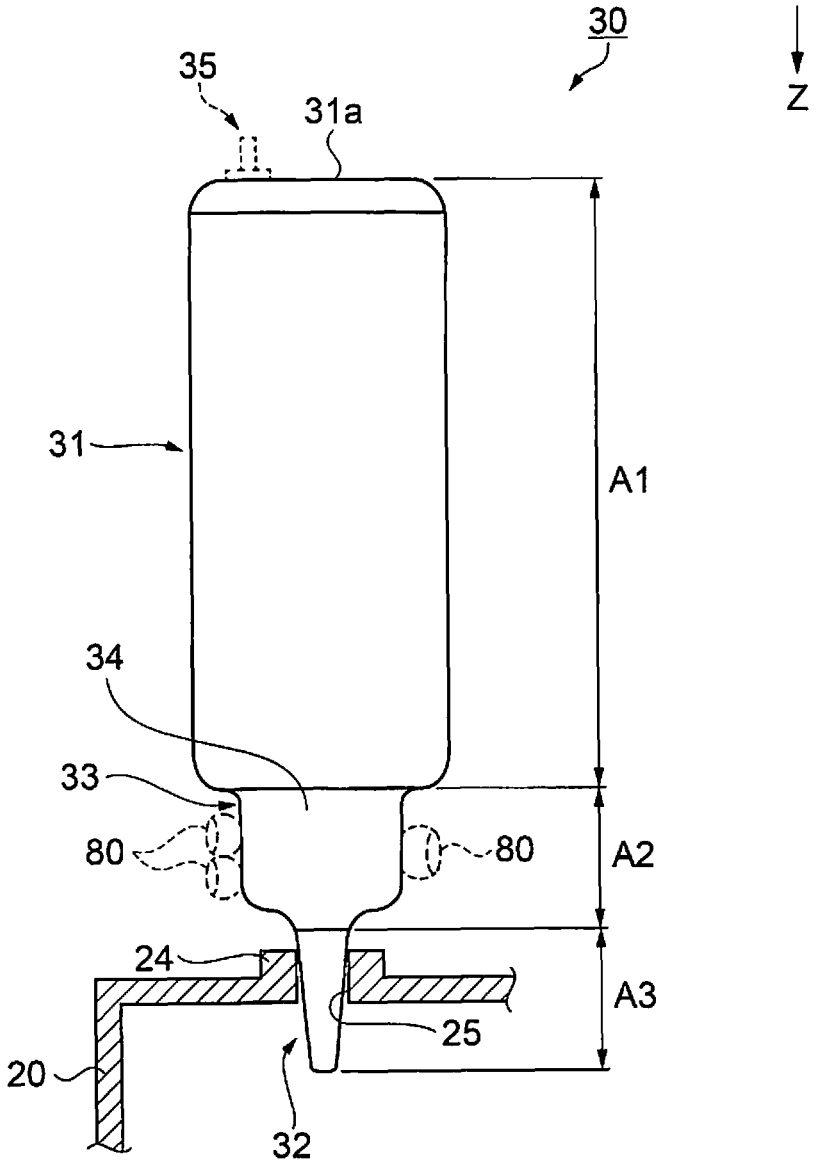
FIG. 2 is a diagram showing a situation in which ink is poured into the ink tank from an ink bottle.

FIG. 2 is a diagram showing a situation in which ink is poured into the ink tank 20 in FIG. 1A from an ink bottle 30 which is an example of a liquid container in the present embodiment. In the present embodiment, the ink is poured in a state in which the case 21 is brought down and the inlet 25 of the ink tank 20 faces up.

The ink bottle 30 is formed of the same synthetic resin having an elastic property. In the vertical direction Z, arrows A1, A2, and A3 respectively indicate ranges in which a liquid containing section 31, a valve mechanism section 33, and a spout 32 are formed. Here, each section is distinguished by a step. However, it is not limited to this. For example, they may be smoothly continued.

The liquid containing section 31 contains ink as liquid. When an external force is applied to the valve mechanism section 33, the valve mechanism section 33 allows the ink in the liquid containing section 31 to flow to the spout 32, and when no external force is applied to the valve mechanism section 33, the valve mechanism section 33 does not allow the ink in the ink liquid containing section 31 to flow to the spout 32.

A plug 35 for sealing an atmosphere opening hole 38 (see FIG. 3A) is detachably provided to a bottom wall 31*a* of the liquid containing section 31. A user inserts the spout 32 into the inlet 25 in a posture in which the spout 32 is lower than the liquid containing section 31 in the vertical direction Z in a state in which the plug 35 is attached and maintains the posture of the ink bottle 30.

Then, the user pulls out the plug 35 from the liquid containing section 31, grips a cylindrical outer wall 34 of the valve mechanism section 33 with fingers 80, and applies an external force to the cylindrical outer wall 34. When the external force is applied to the cylindrical outer wall 34, the external force is transmitted to a conical inner wall 36 (see FIG. 3C) to deform the conical inner wall 36, and an opening/closing section 37 opens, so that the ink in the liquid containing section 31 is poured into the ink tank 20. Hereinafter, the above operation will be described in detail.

Figure 3C:
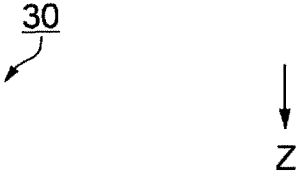
FIGS. 3A to 3D are cross-sectional views of the ink bottle for explaining an operation of a valve mechanism section.
Figure 3D:
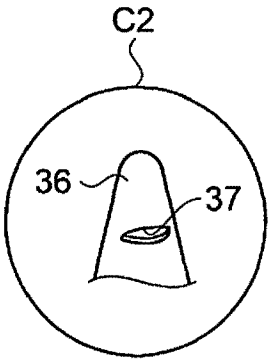
Figure 3A:
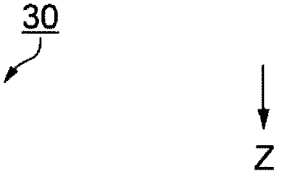

FIGS. 3A and 3C are cross-sectional views of the ink bottle 30 for explaining an operation of the valve mechanism section 33. The ink bottle 30 in FIGS. 3A and 3C is in a state in which the plug 35 is pulled out and the atmosphere opening hole 38 is opened to the atmosphere.

Figure 3B:
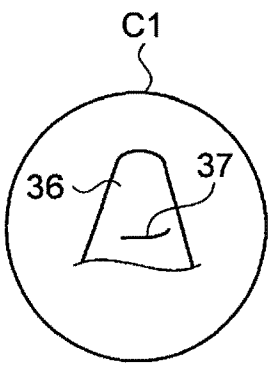

FIG. 3A shows a state in which no external force is applied to the valve mechanism section 33. A diagram in a circle indicated by a symbol C1 in FIG. 3B is an enlarged perspective view of a part in a circle indicated by a dashed line in FIG. 3A. The conical inner wall 36 is formed inside the cylindrical outer wall 34.

A space section 81 is formed inside the bottom wall 31*a* and a cylindrical outer wall 31*b* which form the liquid containing section 31. A space section 82 is formed between the cylindrical outer wall 34 and the conical inner wall 36. A space section 83 is formed inside the conical inner wall 36. A space section 84 is formed inside the spout 32.

By this configuration, inside the ink bottle 30, with the conical inner wall 36 in between, an integrated space section is formed by the space sections 81 and 82 on the opposite side of the spout 32 with respect to the conical inner wall 36 and an integrated space section is formed by the space sections 83 and 84 on the side of the spout 32 with respect to the conical inner wall 36.

As shown inside the circle indicated by the symbol C1, the opening/closing section 37 is formed in the conical inner wall 36. The opening/closing section 37 is formed by cutting a part of the conical inner wall 36 in a circumferential direction.

FIG. 3C shows a state in which an external force B indicated by an arrow is applied to the valve mechanism section 33. A diagram in a circle indicated by a symbol C2 in FIG. 3D is an enlarged diagram of a part in a circle indicated by a dashed line in FIG. 3C.

While the external force B indicated by the arrow is applied to the valve mechanism section 33, as shown inside the circle indicated by the symbol C2, the cylindrical outer wall 34 is deformed. Therefore, the external force is also transmitted to the conical inner wall 36 supported by the cylindrical outer wall 34 and the conical inner wall 36 is deformed. Thereby, the opening/closing section 37 formed in the conical inner wall 36 is opened.

Ink E is reserved in the space sections 81 and 82 formed outside the conical inner wall 36. When no external force is applied to the valve mechanism section 33 as shown in FIG. 3A, the opening/closing section 37 is in a closed state and the ink is prevented from flowing downward. When the external force B is applied to the valve mechanism section 33 as shown in FIG. 3C, the opening/closing section 37 opens and allows the ink to pass through, so that the ink passes through the opening/closing section 37 as indicated by an arrow F1, flows downward, and is poured into the ink tank 20. Thereafter, when the external force B is not applied to the valve mechanism section 33, the valve mechanism section 33 is returned to a state of FIG. 3A by elasticity of the mechanism section 33. As a result, the opening/closing section 37 closes and prevents again the ink from passing through. Thereby, the ink does not flow out, so that it is possible to prevent the ink from spilling out.

The ink bottle 30 described in the present embodiment includes the liquid containing section 31 that contains ink as liquid, the spout 32 from which the ink contained in the liquid containing section 31 is poured, and the valve mechanism section 33 that allows the ink to be poured by being deformed by action of the external force B between the liquid containing section 31 and the spout 32.

According to this configuration, when the ink bottle 30 is held in a state in which the spout 32 is inserted into the inlet 25 of the ink tank 20 and the external force B is applied to the valve mechanism section 33, the valve mechanism section 33 is deformed and the ink is allowed to be poured. Therefore, when the ink is not poured into the ink tank 20, if no external force is applied, the ink is not allowed to be poured, so that it is possible to prevent the ink from spilling out from the spout 32 of the ink bottle 30 to an area around the inlet 25 of the ink tank 20 when the ink bottle 30 is tilted or the posture of the ink bottle 30 is intended to be restored.

The valve mechanism section 33 includes the opening/closing section 37 that is deformed by the action of a force from the outside. The opening/closing section 37 opens when a force is applied from the outside and closes when no force is applied from the outside.

Thereby, when the ink bottle 30 is held in a state in which the spout 32 is inserted into the inlet 25 of the ink tank 20 and a force is applied from the outside to the valve mechanism section 33, the opening/closing section 37 opens and the ink is poured, and when no force is applied from the outside, the opening/closing section 37 closes and the pouring of the ink stops.

The cylindrical outer wall 34 and the conical inner wall 36, which are members included in the valve mechanism section 33, are softer than the cylindrical outer wall 31*b* which is a member included in the liquid containing section 31. Thereby, when a force is applied to the valve mechanism section 33 from the outside, the valve mechanism section 33 can be deformed.

Second Embodiment

In a second embodiment, a configuration will be described in which no external force is applied to the valve mechanism section 33 when the ink bottle is not used. FIG. 4A is a cross-sectional view showing a state in which an ink bottle 30*a* of the present embodiment is used.

The ink bottle 30*a* has a cylindrical external shape and includes the spout 32, the valve mechanism section 33, a valve mechanism containing section 41, and a liquid containing section 40. The ink E is contained in the liquid containing section 40. The plug 35 is detachably provided to the atmosphere opening hole 38 in a bottom wall 40*a* of the liquid containing section 40. A user pours the ink E into the ink tank 20 by changing the posture of the ink bottle 30*a* from the posture of FIG. 4A to a posture in which the spout 32 is located at the bottom.

In the valve mechanism containing section 41, cylindrical outer walls 41*a* and 41*b* form a space section 87 inside the ink bottle 30*a*. In the liquid containing section 40, the bottom wall 40*a* and a cylindrical outer wall 40*b* form a space section 88. In the vertical direction Z, arrows D1, D2, and DA3 respectively indicate ranges in which the cylindrical outer walls 41*a*, 41*b*, and 40*b* are formed. The valve mechanism containing section 41 is formed by the cylindrical outer walls 41*a* and 41*b*. The liquid containing section 40 is formed by the cylindrical outer wall 40*b* and the bottom wall 40*a*.

Figure 4B:
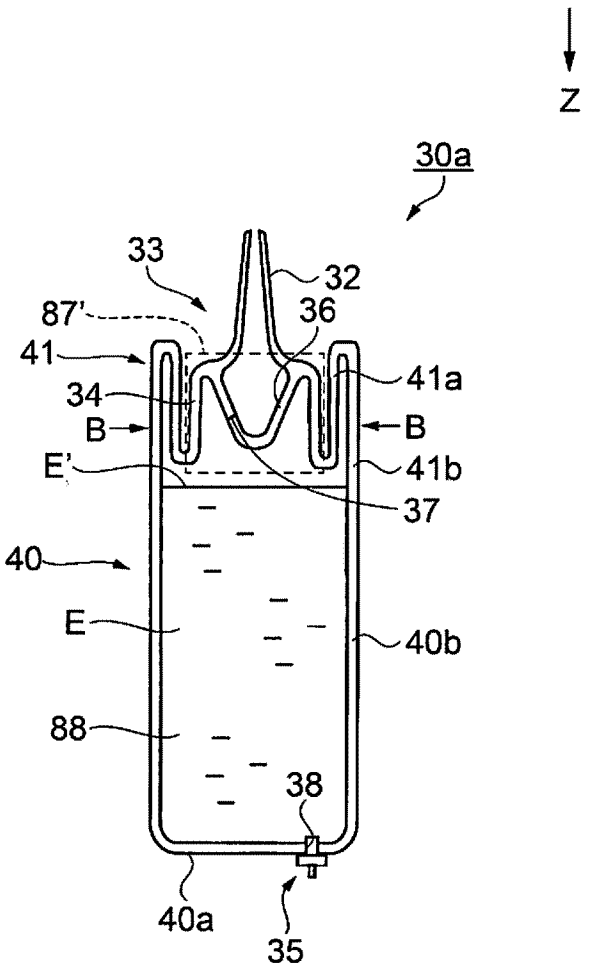
FIGS. 4A and 4B are cross-sectional views showing a state of in-use and a state of not-in-use of an ink bottle in a second embodiment.
Figure 4A:
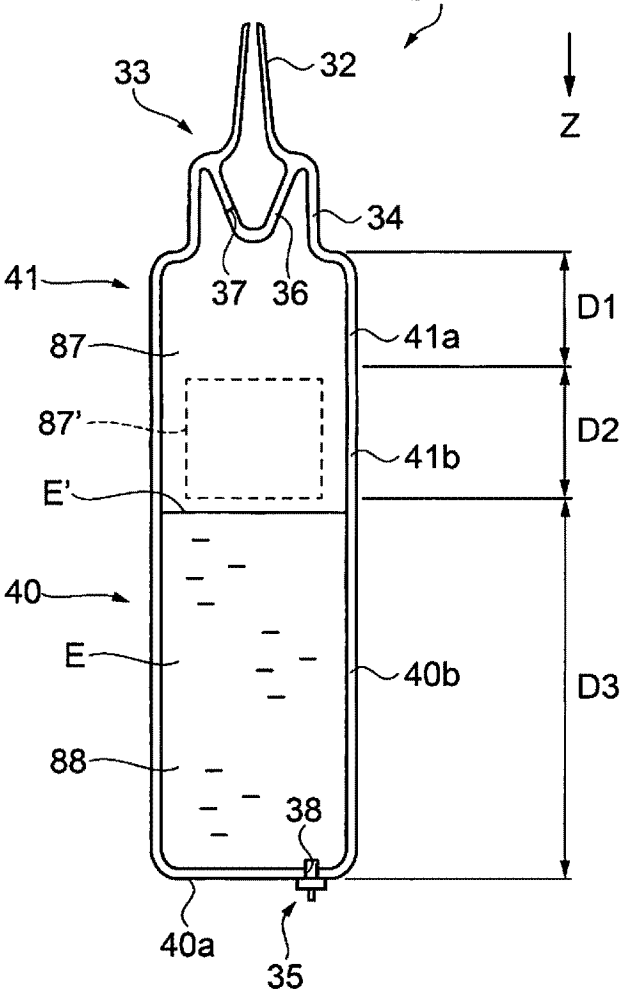

FIG. 4B is a cross-sectional view showing a state in which the ink bottle 30*a* is not used. The cylindrical outer walls 41*b* and 40*b* are continuously formed of the same member. The cylindrical outer wall 41*a* is formed of a member softer than the cylindrical outer walls 41*b* and 40*b*.

Therefore, as shown in FIG. 4B, the valve mechanism section 33 is pressed into the inside of the valve mechanism containing section 41, and the cylindrical outer wall 41*a* faces the cylindrical outer wall 41*b*, so that it is possible to arrange the cylindrical outer wall 41*a* between the cylindrical outer wall 34 of the valve mechanism section 33 and the cylindrical outer wall 41*b*. In other words, the shape of the valve mechanism containing section 41 changes from the shape shown in FIG. 4A to the shape shown in FIG. 4B, so that the valve mechanism section 33 is contained in a space section 87' inside the cylindrical outer walls 41*a* and 41*b*.

When the valve mechanism section 33 of FIG. 4A is located outside the valve mechanism containing section 41, the position of a liquid surface E' of the ink E is located at a position of the liquid containing section 40, so that the space section 87', which is a part of the space section 87, for the valve mechanism section 33 to be contained in the valve mechanism containing section 41 is secured.

In this way, as shown in FIG. 4A, the valve mechanism section 33 can move to a position where the valve mechanism section 33 is located outside the valve mechanism containing section 41 and used and to a containing position where the valve mechanism section 33 is contained in the valve mechanism containing section 41.

By such a configuration, when the valve mechanism section 33 is located at the containing position where the valve mechanism section 33 is contained in the valve mechanism containing section 41, even if the external force B is applied to the valve mechanism containing section 41, no force is applied to the valve mechanism section 33, so that the conical inner wall 36 is not deformed and the opening/closing section 37 is not opened. Thereby, when the ink bottle 30*a* is not used, if the valve mechanism section 33 is located at the containing position where the valve mechanism section 33 is contained in the valve mechanism containing section 41, it is possible to prevent the ink E from flowing out from the spout 32.

Third Embodiment

Figure 5:
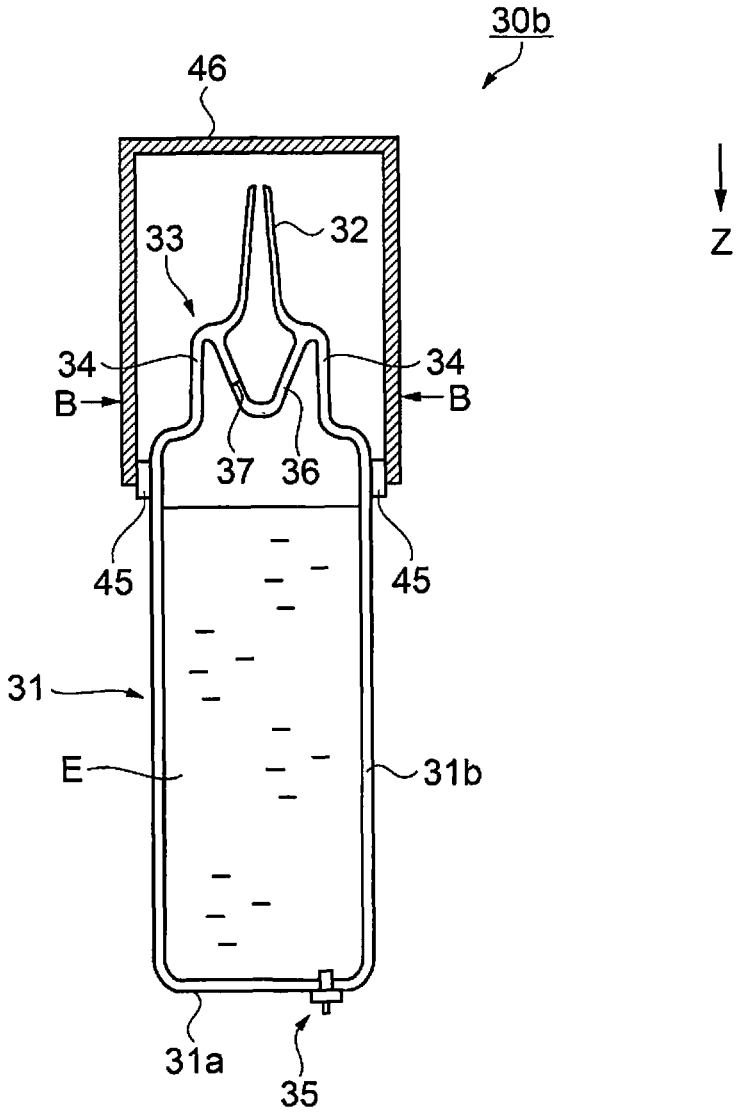
FIG. 5 is a cross-sectional view of an ink bottle in a third embodiment.

In a third embodiment, a configuration will be described in which when the ink bottle is not used, a cap is attached to the ink bottle and no external force is applied to the valve mechanism section 33. FIG. 5 is a cross-sectional view of an ink bottle 30*b* in the present embodiment.

The ink bottle 30*b* is an ink bottle in which a support section 45 and a cap 46 are added to the ink bottle 30 described in the first embodiment. The support section 45 has a ring-like shape and a male screw is formed on an outer surface of the support section 45. The support section 45 is fixed to a part of the cylindrical outer wall 31*b* that forms the liquid containing section 31, and the part faces the valve mechanism section 33. The support section 45 may be a section that is integrally formed with the cylindrical outer wall 31*b*.

The cap 46 has a cylindrical shape. A female screw is formed on an inner surface of the cap 46 and the cap 46 is detachably attached to the support section 45 by the screw. When the cap 46 is attached to the support section 45, the cap 46 covers the valve mechanism section 33. Thereby, even when the external force B is applied to the cap 46, the external force B is not applied to the valve mechanism section 33, so that the conical inner wall 36 is not deformed and the opening/closing section 37 is not opened. Thereby, when the ink bottle 30*b* is not used, if the cap 46 is attached to the support section 45, it is possible to prevent the ink E from flowing out from the spout 32.

Figure 6A:
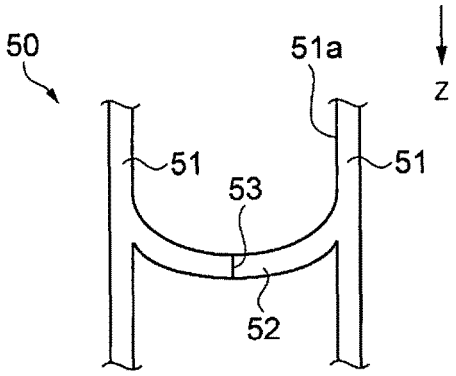
FIGS. 6A to 6D are cross-sectional views showing a valve mechanism section in another embodiment.

In the first to the third embodiment, the opening/closing section 37 is provided to the conical inner wall 36. However, the opening/closing section may be provided to a disk-shaped inner wall. FIGS. 6A and 6C are cross-sectional views of a valve mechanism section 50 in which a disk-shaped inner wall 52 is provided. The disk-shaped inner wall 52 has a curved shape protruding toward a spout (not shown in the drawings).

An outer circumferential surface 52*a* of the disk-shaped inner wall 52 is fixed to an inner circumferential surface 51*a* of a cylindrical outer wall 51. As shown in a perspective view of the disk-shaped inner wall 52 in FIG. 6B, an opening/closing section 53 where the disk-shaped inner wall 52 is linearly and partially cut is provided at a central portion of the disk-shaped inner wall 52. The cylindrical outer wall 51 and the disk-shaped inner wall 52 are formed of a soft member, so that they can be deformed when an external force is applied.

Figure 6B:
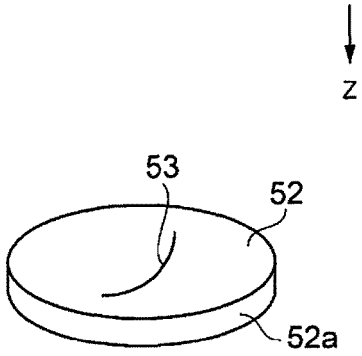
Figure 6C:
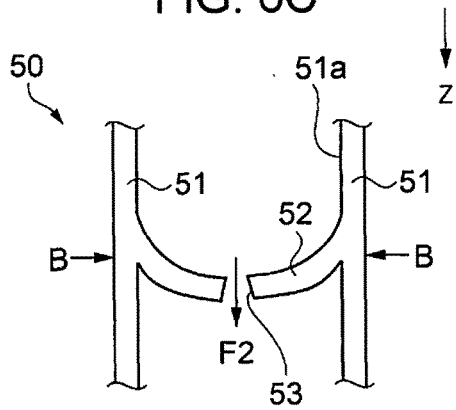
Figure 6D:
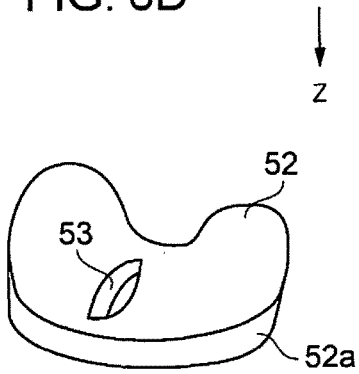

As shown in FIGS. 6A and 6B, when no external force is applied to the valve mechanism section 50, the opening/closing section 53 provided in the disk-shaped inner wall 52 is closed. As shown in FIGS. 6C and 6D, when the external force B is applied to the valve mechanism section 50, the opening/closing section 53 provided in the disk-shaped inner wall 52 is opened.

In a posture of the ink bottle, in which the spout faces down, the opening/closing section 53 is provided in a lowest portion of the disk-shaped inner wall 52. Thereby, the ink can be poured into the ink tank 20 without ink remaining in the liquid containing section.

A cut section provided in the conical inner wall 36 and the disk-shaped inner wall 52 is opened and closed, so that the opening/closing sections 37 and 53 are configured. However, as shown in FIG. 7A, an opening/closing section may be configured by a ring-shaped member 62 provided on a cylindrical outer wall 61 and a disk-shaped member 63.

Figure 7A:
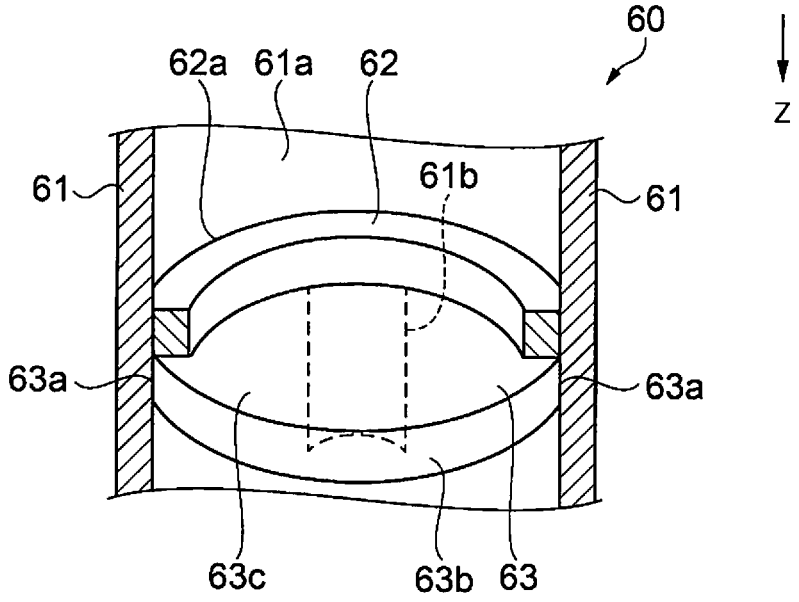
FIGS. 7A and 7B are cross-sectional views showing a valve mechanism section in another embodiment.

FIG. 7A is a perspective view of a valve mechanism section 60 including shaded cross-sections. An outer circumferential surface 62*a* of the ring-shaped member 62 is fixed over the entire circumference of an inner circumferential surface 61*a* of the cylindrical outer wall 61. The ring-shaped member 62 may be integrally formed with the cylindrical outer wall 61.

Figure 7B:
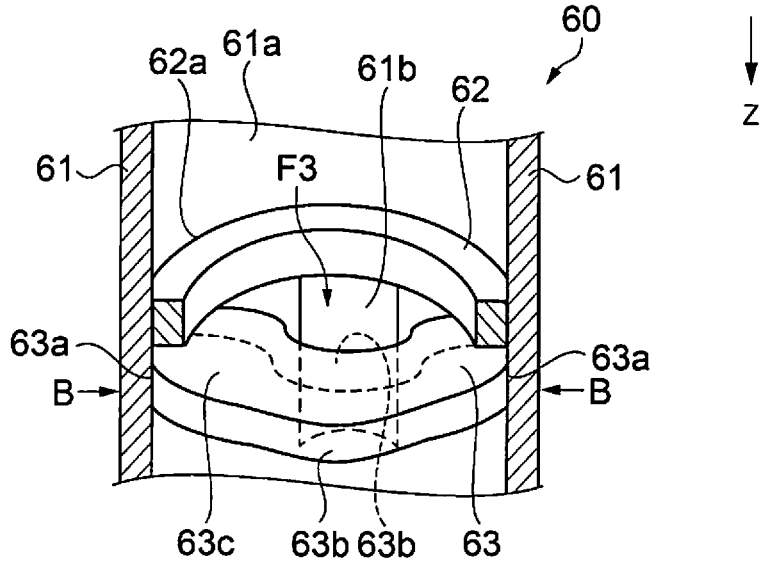

In the disk-shaped member 63, in the horizontal direction in FIGS. 7A and 7B, both ends 63*a* of the outer circumferential surface are fixed to the inner circumferential surface 61*a* of the cylindrical outer wall 61, and a gap is provided between a central portion 63*b* of the outer circumferential surface and the inner circumferential surface 61*a* of the cylindrical outer wall 61.

When no external force is applied to the valve mechanism section 60, as shown in FIG. 7A, an end 63*c* of the disk-shaped member 63 facing the ring-shaped member 62 is in contact with the ring-shaped member 62 over the entire circumference. Therefore, the valve mechanism section 60 does not allow the ink to flow.

The cylindrical outer wall 61, the ring-shaped member 62, and the disk-shaped member 63 are formed of a soft member. Thereby, as shown in FIG. 7B, when the external force B is applied to the valve mechanism section 60, the cylindrical outer wall 61 is deformed and the disk-shaped member 63 is separated from the ring-shaped member 62 and is bent into a shape protruding downward in FIG. 7B.

Thereby, the ink passes between the ring-shaped member 62 and the end 63*c* of the disk-shaped member 63 and further flows through a gap between the central portion 63*b* on the outer circumferential surface of the disk-shaped member 63 and the inner circumferential surface 61*a* of the cylindrical outer wall 61.

In the valve mechanism section 60, a pair of groove sections 61*b* extending in the vertical direction in FIGS. 7A and 7B, are formed on the inner circumferential surface 61*a* of the cylindrical outer wall 61 at a position facing the central portion 63*b* on the outer circumferential surface of the disk-shaped member 63. When the disk-shaped member 63 is bent into a shape protruding downward in FIG. 7B, the ink flows through the pair of groove sections 61B as indicated by an arrow F3.

In this way, the valve mechanism section 60 including the ring-shaped member 62 provided to the cylindrical outer wall 61 and the disk-shaped member 63 is provided, so that it is possible to increase the amount of flowing ink.

Each embodiment described above only shows an aspect of the invention, so that it is possible to combine the embodiments and/or further arbitrarily modify and apply the combination within the scope of the invention. As modified examples, for example, the following modified examples are considered.

Modified Example 1

The valve mechanism section is not limited to those described above. It is possible to employ various valves which allow ink to be poured by applying an external force at least in a predetermined manner. For example, it is possible to employ a valve which requires a knack for applying the external force to pour the ink. The valve mechanism section is desired to be a valve that is restored and prevents the ink from being poured when the external force disappears. For example, the valve mechanism section may be a valve that prevents the ink from being poured when an external force is applied to the valve in a manner different from that when the ink is poured. When the ink bottle is disposable, the valve mechanism section need not be restored.

Modified Example 2

In the ink bottle 30, boundaries between the liquid containing section 31, the valve mechanism section 33, and the spout 32 may be indistinctly formed. For example, the valve mechanism section 33 and the spout 32 are integrated together. The ink bottle 30 may have parts not described above, such as a handle for a user to grip.

Modified Example 3

Figure 8:
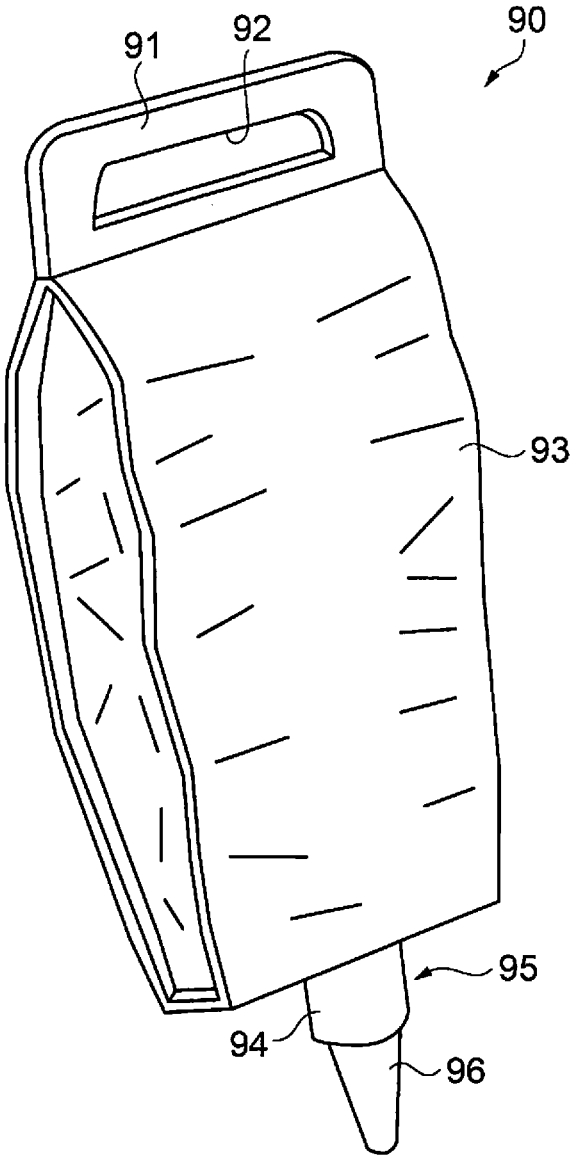
FIG. 8 is a perspective view of another liquid container.

The plug 35 and the atmosphere opening hole 38 need not be included. In this case, it is desirable that when the ink is poured, the liquid containing section 31 or 40 is deformed to be small in volume by the ink flowing out. For example, like a liquid container 90 in FIG. 8, a liquid containing section 93 may have a soft bag shape. The liquid container 90 includes a grip section 91 where a through hole 92 is formed and a valve mechanism section 95 including a cylindrical outer wall 94. A user grips the grip section 91 with one hand and inserts a spout 96 into an inlet (not shown in FIG. 8) of an ink tank (not shown in FIG. 8). Then, the user applies an external force to the cylindrical outer wall 94 with the other hand to deform the valve mechanism section 95, so that the ink is allowed to be poured.

Modified Example 4

The whole ink bottle may be formed of the same synthetic resin or may be formed by combining different synthetic resins. It is possible to use materials other than synthetic resins. When the ink bottle is formed of the same material, strength may be changed by changing thickness and shape depending on a position.

Modified Example 5

The liquid need not be ink, but may be various liquids such as water, oil, and solution or suspension liquid of these, which are contained in a liquid container. Further, the liquid container is not limited to a liquid container for using liquid for a liquid ejecting apparatus, but may be a liquid container used for various purposes.

What is claimed is:

1. A liquid container, comprising:

a liquid containing section that contains liquid;

a spout from which the liquid contained in the liquid containing section is poured; and a valve mechanism section disposed in the middle of a flow path connecting the liquid containing section and the spout, the valve mechanism section including an outer wall and the valve mechanism section being configured to allow the liquid to flow by deforming the outer wall of the valve mechanism section by action of a force applied to the outer wall from outside toward the center of the flow path;

a cap configured to cover the valve mechanism section;

a support section that attachably and detachably supports the cap, the support section being disposed on an opposite side of the valve mechanism section with respect to the spout, the cap being further configured to cover the spout and the outer wall of the valve mechanism section in a state of being separated from the outer wall of the valve mechanism section when the cap is attached to the support section.

2. The liquid container according to claim 1, wherein the valve mechanism section allows the liquid to be poured when a force is applied from outside to deform the outer wall of the valve mechanism section and restores its original shape by elasticity of the valve mechanism section and prevents the liquid from being poured when no force is applied from outside.

3. The liquid container according to claim 1, wherein a member that forms the valve mechanism section is softer than a member that forms the liquid containing section.

4. The liquid container according to claim 1, wherein the support section has a support section outer wall which is larger than the outer wall of the valve mechanism section.

5. A liquid container, comprising:

a liquid containing section that contains liquid;

a spout from which the liquid contained in the liquid containing section is poured;

a valve mechanism section disposed in the middle of a flow path connecting the liquid containing section and the spout, the valve mechanism section including an outer wall and the valve mechanism section being configured to allow the liquid to flow by deforming the outer wall of the valve mechanism section by action of a force applied to the outer wall from outside toward the center of the flow path; and a valve mechanism containing section, which contains the valve mechanism section, in a region between the valve mechanism section and the liquid containing section, wherein the valve mechanism section is configured to move to a containing position where the valve mechanism section is contained in the valve mechanism containing section and a use position outside the valve mechanism containing section.

* * * * *